US008912715B2

(12) United States Patent
Ban

(10) Patent No.: US 8,912,715 B2
(45) Date of Patent: Dec. 16, 2014

(54) SPARK PLUG

(71) Applicant: NGK Spark Plug Co., Ltd., Nagoya, Aichi (JP)

(72) Inventor: Kenji Ban, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/349,476

(22) PCT Filed: Dec. 6, 2012

(86) PCT No.: PCT/JP2012/007820

§ 371 (c)(1), (2), (4) Date: Apr. 3, 2014

(87) PCT Pub. No.: WO2013/099117

PCT Pub. Date: Jul. 4, 2013

(65) Prior Publication Data

US 2014/0239797 A1 Aug. 28, 2014

(30) Foreign Application Priority Data

Dec. 26, 2011 (JP) ..... 2011-282777

(51) Int. Cl.

| | |
|---|---|
| ***H01T 13/20*** | (2006.01) |
| ***H01T 13/32*** | (2006.01) |
| ***H01T 13/16*** | (2006.01) |
| ***H01T 13/39*** | (2006.01) |

(52) U.S. Cl.

CPC ..... *H01T 13/32* (2013.01); *H01T 13/16* (2013.01); *H01T 13/39* (2013.01)

USPC ..... 313/141; 313/118

(58) Field of Classification Search

CPC ..... H01T 1/24; H01T 1/00; H01T 1/22; H01T 1/15; H01T 1/14; H01T 13/32; H01T 13/16; H01T 13/39

USPC ..... 313/141, 118, 142; 445/7

See application file for complete search history.

(56) References Cited

U.S. PATENT DOCUMENTS

| | | | | |
|---|---|---|---|---|
| 4,700,103 | A | 10/1987 | Yamaguchi et al. | 313/141 |
| 7,224,109 | B2 | 5/2007 | Kanao | 313/141 |
| 8,013,503 | B2 | 9/2011 | Kameda et al. | 313/141 |

(Continued)

FOREIGN PATENT DOCUMENTS

| | | | |
|---|---|---|---|
| JP | 61-44583 | 3/1986 | H01T 13/20 |
| JP | 2003-059618 | 2/2003 | H01T 13/20 |

(Continued)

OTHER PUBLICATIONS

US 8,212,461, 07/2012, Kameda et al. (withdrawn).

(Continued)

*Primary Examiner* — Nimeshkumar Patel
*Assistant Examiner* — Glenn Zimmerman
(74) *Attorney, Agent, or Firm* — Kusner & Jaffe

(57) ABSTRACT

A spark plug having a center electrode, a ground electrode, and a ground electrode side tip. The tip partially projects from a front end face and an inner circumference-side side surface of the ground electrode. The ground electrode has a center of the front end face, which center is located at a front end side in a direction of the axis with respect to a front end of the center electrode.

4 Claims, 4 Drawing Sheets

(56) References Cited

U.S. PATENT DOCUMENTS

| | | | | |
|---|---|---|---|---|
| 8,013,504 | B2 | 9/2011 | Kameda et al. | 313/141 |
| 8,120,235 | B2 | 2/2012 | Nunome et al. | 313/141 |
| 8,188,641 | B2 | 5/2012 | Kameda et al. | 313/142 |
| 8,217,561 | B2 | 7/2012 | Fukuzawa et al. | 313/141 |
| 8,324,791 | B2 | 12/2012 | Kameda et al. | 313/141 |
| 2009/0322198 | A1* | 12/2009 | Kameda et al. | 313/141 |
| 2010/0019644 | A1* | 1/2010 | Fukuzawa et al. | 313/141 |
| 2010/0096968 | A1* | 4/2010 | Ban et al. | 313/141 |
| 2011/0215702 | A1* | 9/2011 | Kameda et al. | 313/141 |
| 2012/0074828 | A1* | 3/2012 | Inoue et al. | 313/141 |
| 2012/0112619 | A1* | 5/2012 | Kasuya et al. | 313/141 |
| 2012/0313503 | A1 | 12/2012 | Kasuya et al. | 313/141 |

FOREIGN PATENT DOCUMENTS

| | | | |
|---|---|---|---|
| JP | 2005-339864 | 12/2005 | H01T 13/39 |
| JP | 2007-234435 | 9/2007 | H01T 13/20 |
| JP | 2009-129908 | 6/2009 | H01T 13/32 |
| JP | 2010-80059 | 4/2010 | H01T 13/20 |
| JP | 2011-141953 A | 7/2011 | H01T 13/32 |
| JP | 2011-171305 | 9/2011 | H01T 13/20 |

OTHER PUBLICATIONS

International Search for International Application PCT/JP2012/007820, Feb. 26, 2013.

* cited by examiner

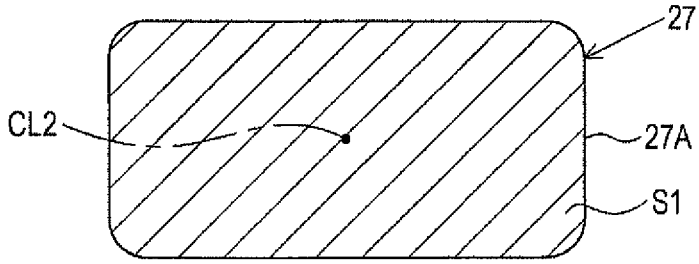
FIG. 4(a)
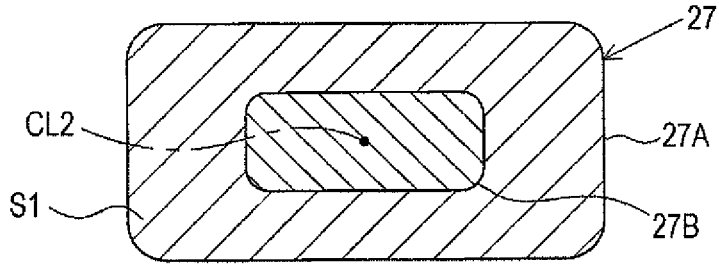
FIG. 4(b)
FIG. 5
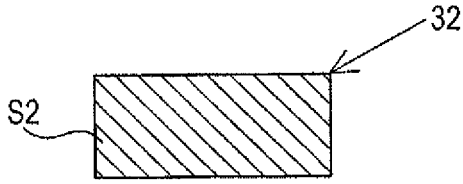

SPARK PLUG

FIELD OF THE INVENTION

The present invention relates to a spark plug used for an internal combustion engine or the like.

BACKGROUND OF THE INVENTION

A spark plug used in an internal combustion engine or the like, for example, includes a center electrode extending in a direction of an axis, a tubular insulator disposed at the outer circumference of the center electrode, a tubular metallic shell disposed at the outer circumference of the insulator, and a ground electrode with a base end joined to the front end portion of the metallic shell. Further, the ground electrode is bent at an approximately center thereof such that the front end portion of the ground electrode faces the front end portion of the center electrode. A spark discharge gap is formed between the front end portion of the center electrode and the front end portion of the ground electrode.

In recent years, from the aspect of environmental protection, to obtain sufficient output while achieving low displacement, a high-compression and high supercharging engine may be employed. With such engine, a vibration applied to the ground electrode during operation of the engine tends to be large. Accordingly, breakage may occur at a flexed portion of the ground electrode where stress due to vibration is especially concentrated.

Therefore, to prevent breakage of the ground electrode, a technique that eliminates the flexed portion and makes the ground electrode a straight bar (straight) is proposed (for example, see JP 2003-59618 A or the like). A technique that increases the diameter of crystal grains at the flexed portion of the ground electrode to prevent the breakage of the ground electrode is known (for example, see JP 2005-339864 A or the like).

However, with the technique described in the above-described JP 2003-59618 A, the ground electrode comes closer to the center electrode not only at the front end portion but also at the middle portion. Hence, the presence of the ground electrode inhibits growth of a spark generated at a spark discharge gap, resulting in reduced ignitability.

With the technique described in the above-described JP 2005-339864 A, the stress applied to the flexed portion of the ground electrode due to vibration is still large. The breakage of the ground electrode may not be sufficiently prevented.

The present invention has been conceived to solve the above-mentioned problems. An advantage of the invention is a spark plug in which the breakage of the ground electrode or the like can further reliably be prevented while achieving superior ignitability.

SUMMARY OF THE INVENTION

Configurations suitable for achieving the above advantage will be described in itemized form. As needed, actions and effects specific to the configurations will be described additionally.

Configuration 1: In accordance with the present invention, there is provided a spark plug that includes: an insulator having an axial hole penetrating in a direction of an axis; a center electrode inserted into the axial hole; a tubular metallic shell disposed at an outer circumference of the insulator; a ground electrode secured to a front end portion of the metallic shell, and bent to the axis side at a flexed portion; and a tip joined to a front end portion of the ground electrode to form a gap between the tip and a front end portion of the center electrode. The tip is joined to the ground electrode with a part of the tip projecting from a front end face and an inner circumference-side side surface of the ground electrode, and the ground electrode has a center of the front end face, the center being located at a front end side in the direction of the axis with respect to a front end of the center electrode. $L/X \leq 1.28$ is satisfied, where L (mm) represents a length of the ground electrode along a central axis of the ground electrode and X (mm) represents a projection length of the ground electrode relative to a front end face of the metallic shell along the axis. $8.4 \leq (S1/S2)/A$ is satisfied, where S1 ($mm^2$) represents a cross section area of a portion at a base end side with respect to a portion where the tip is joined to the ground electrode in cross section perpendicular to the central axis of the ground electrode, S2 ($mm^2$) represents a cross section area of the tip in cross section perpendicular to a projection direction of the tip relative to the front end of the ground electrode, and A (mm) represents a projection length of the tip relative to the front end face of the ground electrode in a longitudinal direction of the ground electrode.

Configuration 2: In accordance with a second aspect of the present invention, there is provided a spark plug as described above, wherein $13.1 \leq (S1/S2)/A$ is satisfied in the above configuration 1.

Configuration 3: In accordance with a third aspect of the present invention, there is provided a spark plug as described above in the above configuration 1 or 2, wherein the ground electrode further includes an outer layer and an inner layer. The inner layer is disposed inside of the outer layer, and is made of a metal with higher thermal conductivity than a thermal conductivity of the outer layer.

Configuration 4: In accordance with a fourth aspect of the present invention, there is provided a spark plug as described above, wherein $1.7 \leq S1 \leq 3.0$ is satisfied in the above configuration 3.

According to the spark plug of the configuration 1, the flexed portion is disposed at the ground electrode. This allows forming a comparatively large space between the ground electrode and the center electrode and further reliably preventing inhibition of growth of a spark by the ground electrode. Furthermore, since the center of the front end face of the ground electrode is located at the front end side in the direction of axis with respect to the front end of the center electrode, allowing the gap to be formed at the center side of the combustion chamber. Consequently, good ignitability can be achieved.

Meanwhile, in the case where the center of the front end face of the ground electrode is disposed at the front end side with respect to the front end of the center electrode, that is, in the case where the ground electrode protrudes from the front end of the metallic shell at comparatively large extent, stress applied to the ground electrode tends to increase when the ground electrode is subjected to vibration. As a result, breakage generated at a flexed portion of the ground electrode is likely to occur.

In this respect, according to the above-described configuration 1, the present invention is configured to satisfy $L/X \leq 1.28$. A projection amount of the ground electrode toward the axis side (the length of the ground electrode along the direction perpendicular to the axis when viewed from the front end side in the direction of axis) is comparatively small. That is, since the stress applied to the flexed portion due to vibration corresponds to the projection amount, decreasing the projection amount can efficiently reduce the stress applied to the flexed portion. As a result, breakage at the flexed portion of the ground electrode can be further reliably prevented.

In the meantime, decreasing the projection amount of the ground electrode toward the axis is effective in that the breakage resistance of the ground electrode is enhanced. However, there is a concern that the front end portion of the ground electrode cannot be disposed sufficiently close to the center electrode. If the front end portion of the ground electrode fails to be sufficiently close to the center electrode, in the case where a gap is attempted to be formed between the front end portion of the ground electrode and the center electrode, the gap becomes comparatively large. Accordingly, the above-described superior ignitability may not be stably achieved.

To solve this respect, according to the above-described configuration 1, a tip is joined to the front end portion of the ground electrode. The tip partially projects from the front end face and the inner circumference-side side surface of the ground electrode. A gap is formed between the tip and the front end portion of the center electrode, therefore enabling the gap formed with an appropriate size, producing ignitability with superior stability. Additionally, since the tip partially projects from the front end face and the inner circumference-side side surface of the ground electrode, the ground electrode is farther away from the gap. Therefore, inhibition of growth of a spark by the ground electrode can further reliably be prevented while achieving superior ignitability.

In the meantime, when the tip is configured so as to project from the front end face of the ground electrode, the tip tends to be overheated. If the tip is overheated, the strength of the tip degrades. Accordingly, a vibration may cause breakage of the tip at the root side of the portion projecting from the front end face of the ground electrode (the coupling portion side with the ground electrode).

In this respect, according to the above-described configuration 1, the present invention is configured to satisfy $8.4\ (mm^{-1}) \leq (S1/S2)/A$. That is, the volume ($S2 \times A$) of the projecting portion of the tip projected from the front end face of the ground electrode is equivalent to the heat receiving amount of the projecting portion during operation of the internal combustion engine or the like. A cross section area S1 of the ground electrode is equivalent to the heat conduction capacity (the heat conduction capacity of the ground electrode) that the ground electrode transfers heat of the projecting portion to the metallic shell side. Then, satisfying $8.4 \leq (S1/S2)/A$, namely, $8.4 \leq S1/(S2 \times A)$ sufficiently increases the heat conduction capacity of the ground electrode relative to the heat receiving amount of the projecting portion, resulting in efficient prevention of overheating of the tip. This consequently also allows sufficiently maintaining the strength of the tip under high temperature and further reliably preventing breakage of the tip.

According to the spark plug of the configuration 2, the present invention is configured to satisfy $13.1 \leq (S1/S2)/A$. This allows efficiently and dramatically preventing the tip from overheating. As a result, the breakage resistance of the tip can be dramatically improved.

According to the spark plug of the configuration 3, the ground electrode includes an inner layer with higher thermal conductivity than that of the outer layer. This allows the tip heat to be smoothly conducted to the metallic shell side via the inner layer and further reliably preventing the overheating of the tip. As a result, the breakage resistance of the tip can be further improved.

According to the spark plug of the configuration 4, the cross section area S1 of the ground electrode is equal to or less than 3.0 $mm^2$. This reduces the likelihood of inhibition of growth of a spark due to the existence of the ground electrode. Additionally, in the case where the ground electrode is disposed between the gap and a fuel injection device, air-fuel mixture goes around the ground electrode and easily gets through the gap. This further improves ignitability.

Meanwhile, in the case where the cross section area S1 is equal to or less than 3.0 $mm^2$, the heat conduction capacity of the ground electrode possibly degrades. However, according to the above-described configuration 4, disposing the inner layer at the ground electrode allows ensuring superior heat conduction capacity of the ground electrode. As a result, ignitability is further improved while maintaining superior breakage resistance at the tip. In other words, the above-described configuration 3 is especially effective in the case where the cross section area S1 is equal to or less than 3.0 $mm^2$.

If the cross section area S1 is excessively small, even if an inner layer is disposed, ensuring superior heat conduction capacity at the ground electrode may become difficult. However, according to the above-described configuration 4, the cross section area S1 is equal to or more than 1.7 $mm^2$. This allows further reliably ensuring superior heat conduction capacity at the ground electrode and further reliably improving the breakage resistance of the tip.

BRIEF DESCRIPTION OF THE DRAWINGS

FIG. 4(*a*) is a sectional view taken along the line J-J of FIG. 2, and FIG. 4(*b*) is a sectional view taken along the line K-K of FIG. 2.

FIG. 5 is a sectional view taken along the line P-P of FIG. 2.

DETAILED DESCRIPTION OF PREFERRED EMBODIMENTS

Figure 1:
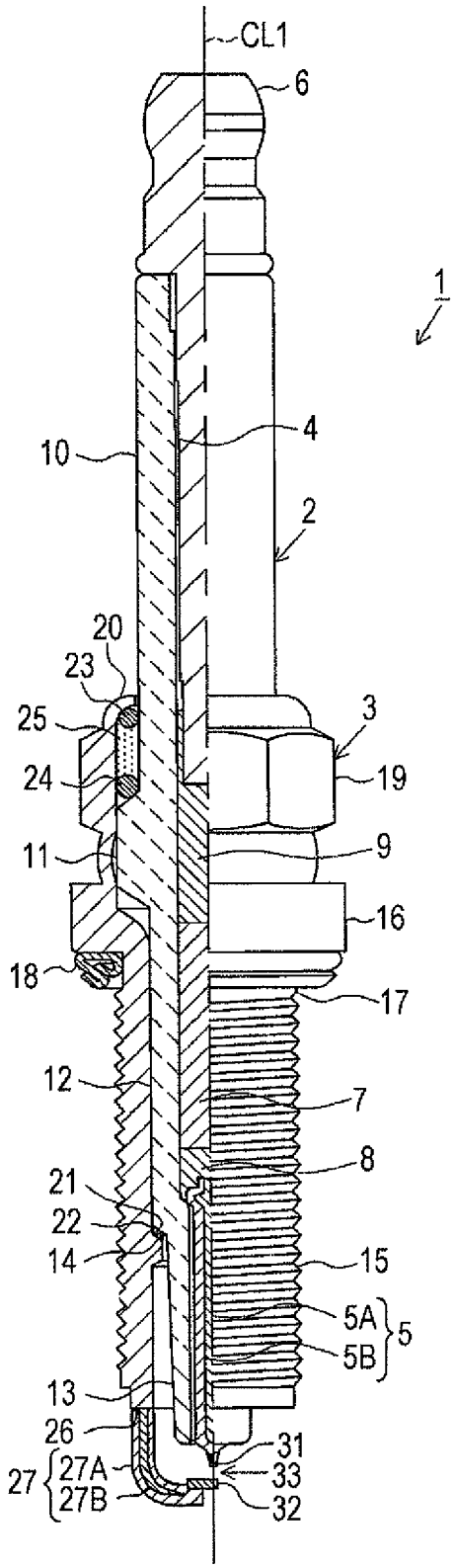
FIG. 1 is a partially sectioned front view showing the configuration of a spark plug.

One embodiment will now be described with reference to the drawings. FIG. 1 is a partially sectioned front view showing a spark plug 1. Incidentally, in FIG. 1, the direction of an axis CL1 of the spark plug 1 is referred to as the vertical direction. In the following description, the lower side of the spark plug 1 in FIG. 1 is referred to as the front end side of the spark plug 1, and the upper side as the rear end side.

The spark plug 1 includes a tubular insulator 2 and a tubular metallic shell 3 which holds the insulator 2 therein.

The insulator 2 is formed from alumina or the like by firing, as well known in the art. The insulator 2, as viewed externally, includes a rear trunk portion 10 formed on the rear end side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and an leg portion 13, which is located frontward of the intermediate trunk portion 12 and is smaller in diameter than the intermediate trunk portion 12. In addition, the large-diameter portion 11, the intermediate trunk portion 12, and a majority of the leg portion 13 of the insulator 2 are accommodated within the metallic shell 3. A tapered step portion 14 is formed at a coupling portion between the intermediate trunk portion 12 and the leg portion 13. The insulator 2 is seated on the metallic shell 3 at the step portion 14.

Further, the insulator 2 has an axial hole 4 penetrating therethrough along the axis CL1. A center electrode 5 is inserted into a front end side of the axial hole 4. The center electrode 5 includes a core portion 5A formed of metal having superior thermal conductive properties (for example, copper and copper alloy) and an outer skin portion 5B formed of an alloy which contains nickel (Ni) as a main constituent. Additionally, the center electrode 5 has a rod-like shape (a circular columnar shape) as a whole, and has a flat front end face. The front end face of the center electrode 5 projects from the front end portion of the insulator 2. A circular center electrode side tip 31 formed of a metal superior in wear resistance (such as a metal containing one or more components of Pt, Ir, Pd, Rh, Ru, Re) is provided at the front end portion of the center electrode 5.

Also, a terminal electrode 6 is fixedly inserted into a rear end portion of the axial hole 4 and projects from the rear end of the insulator 2.

A circular columnar resistor 7 is disposed within the axial hole 4 between the center electrode 5 and the terminal electrode 6. Both opposite end portions of the resistor 7 are electrically coupled to the center electrode 5 and the terminal electrode 6, respectively, via electrically conductive glass seal layers 8 and 9.

The metallic shell 3 is formed into a tubular shape from a low-carbon steel or a like metal. The metallic shell 3 has, on its outer circumferential surface, a thread portion (external thread portion) 15 adapted to mount the spark plug 1 into a mounting hole of a combustion apparatus (e.g., an internal combustion engine or a fuel cell reformer). Also, the metallic shell 3 has a seat portion 16 on its outer circumferential surface located rearward of the thread portion 15. The seat portion 16 protrudes radially outward. A ring-like gasket 18 is fitted to a thread root 17 at the rear end of the thread portion 15. Further, the metallic shell 3 has, near the rear end thereof, a tool engagement portion 19 having a hexagonal cross-sectional shape and allowing a tool, such as a wrench, to be engaged therewith when the metallic shell 3 is to be mounted to the combustion apparatus. Also, the metallic shell 3 has a crimping portion 20 provided at a rear end portion thereof for retaining the insulator 2.

Also, a tapered step portion 21 is formed on the inner circumferential surface of the metallic shell 3 so as to be seated on the insulator 2. The insulator 2 is inserted frontward into the metallic shell 3 from the rear end of the metallic shell 3. In a state where the step portion 14 of the insulator 2 is seated on the step portion 21 of the metallic shell 3, a rear-end opening portion of the metallic shell 3 is crimped radially inward. That is, the above-mentioned crimping portion 20 is formed to fix the insulator 2 to the metallic shell 3. An annular sheet packing 22 is interposed between the step portions 14 and 21. This retains gastightness of a combustion chamber and prevents outward leakage of fuel gas which enters the clearance between the inner circumferential surface of the metallic shell 3 and the leg portion 13 of the insulator 2, which are exposed to the combustion chamber.

Further, in order to ensure gastightness which is established by crimping, annular ring members 23 and 24 are interposed between the metallic shell 3 and the insulator 2 in a region near the rear end of the metallic shell 3, and a space between the ring members 23 and 24 is filled up with powder of talc 25. That is, the metallic shell 3 holds the insulator 2 via the sheet packing 22, the ring members 23 and 24, and the talc 25.

Figure 2:
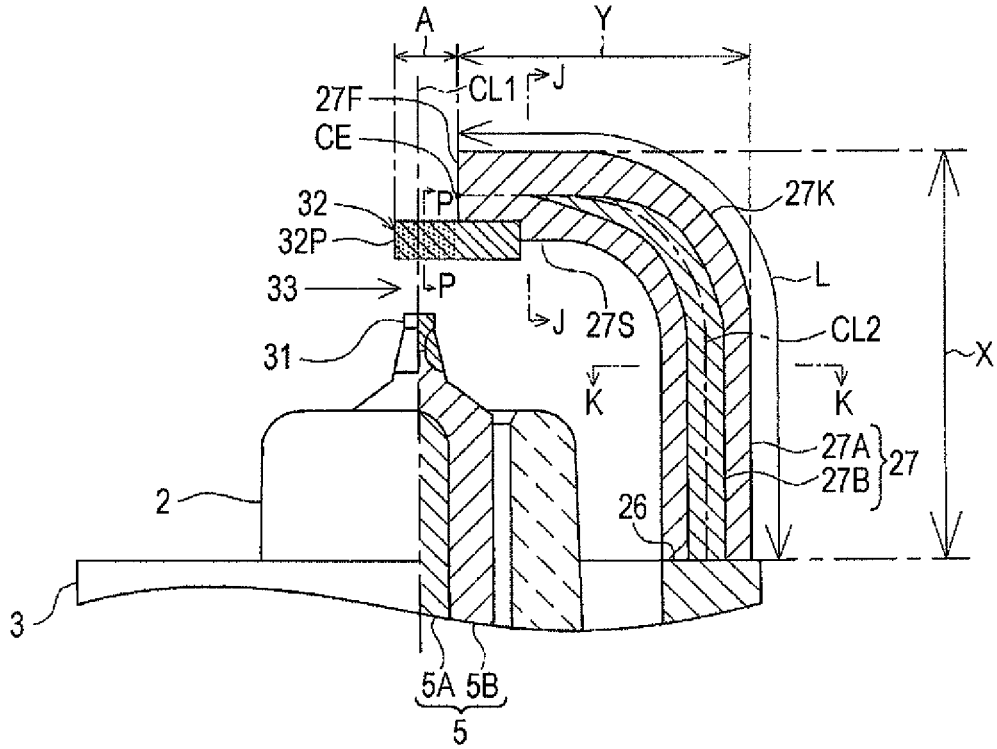
FIG. 2 is a partially sectioned front view showing the configuration of a front end portion of the spark plug in an enlarged manner.
Figure 3:
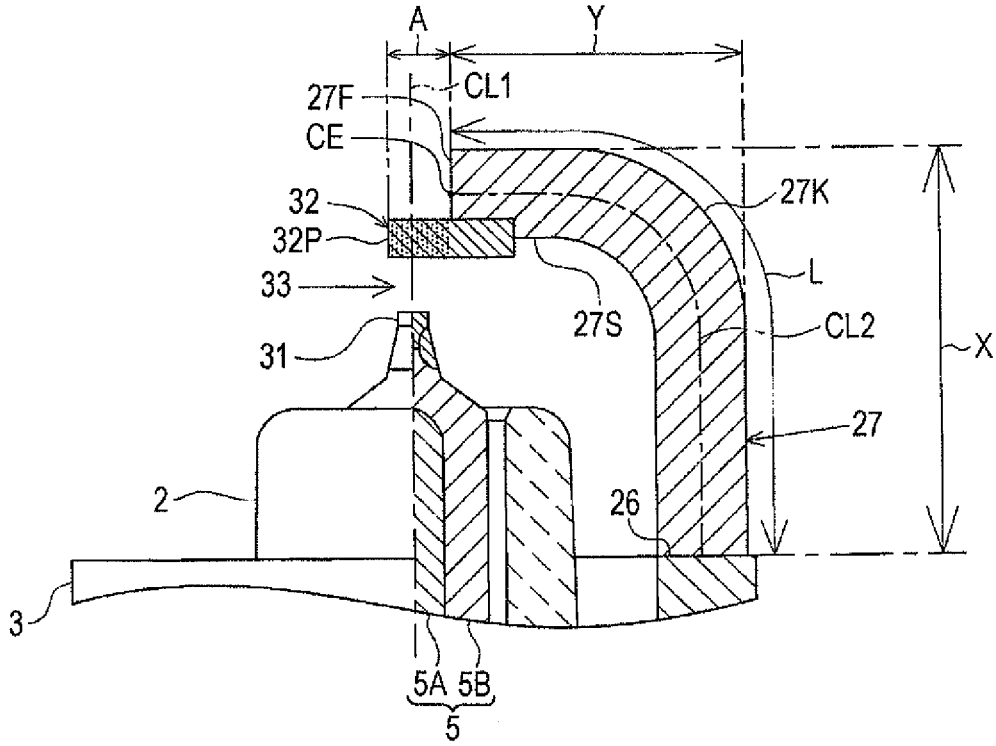
FIG. 3 is a partially sectioned front view showing a front end portion of the spark plug of the ground electrode according to another example in an enlarged manner.

As shown in FIG. 2, the base end portion of the rod-shaped ground electrode 27 is joined to a front end portion 26 of the metallic shell 3. The ground electrode 27 has a rectangular cross-sectional shape. The ground electrode 27 is bent at a flexed portion 27K, which is disposed at an approximately center thereof, toward the axis CL1 side. Additionally, the ground electrode 27 includes an outer layer 27A and an inner layer 27B. The outer layer 27A is formed by Ni alloy (for example, inconel 600 and inconel 601 (both are registered trademarks)). The inner layer 27B is disposed inside of the outer layer 27A. The inner layer 27B is formed by a metal with superior thermal conductivity than that of the outer layer 27A (e.g. copper and copper alloy). As shown in FIG. 3, the ground electrode 27 may be configured by a single metal (for example, Ni alloy) without disposing the inner layer 27B at the ground electrode 27.

Referring again to FIG. 2, the ground electrode side tip 32 with a rectangular parallelepiped shape (equivalent to "a tip" in the present invention) is joined to the front end portion of the ground electrode 27. The ground electrode side tip 32 is made of a metal with superior wear resistance (such as a metal containing one or more components of Pt, It; Pd, Rh, Ru, Re). The ground electrode side tip 32 partially projects from an inner circumference-side side surface 27S located at the center electrode 5 side in the side surface of the ground electrode 27 and a front end face 27F of the ground electrode 27. The ground electrode side tip 32 is also joined to the ground electrode 27 while being partially implanted into the ground electrode 27. Additionally, the spark discharge gap 33 as a gap is formed between the surface located at the center electrode 5 side in the side surface of the ground electrode side tip 32 and the front end face of the center electrode 5 (center electrode side tip 31). Thus, spark discharge is performed at the spark discharge gap 33 in the direction approximately along the axis CL1.

In this embodiment, as described above, since the ground electrode side tip 32 is partially implanted into the ground electrode 27, the shortest distance between the ground electrode side tip 32 and the inner layer 27B is comparatively small (e.g. equal to or less than 0.9 mm). Additionally, the size of a spark discharge gap 33 (the shortest distance between the ground electrode side tip 32 and the front end portion of the center electrode 5) is configured within the range of a predetermined value (for example, equal to or more than 0.5 mm and equal to or less than 1.4 mm).

Additionally, in this embodiment, a center CE at the front end face 27F of the ground electrode 27 (the intersection point of a central axis CL2 and the front end face 27F) is located at the front end side in the axis CL1 direction with respect to the front end of the center electrode 5 (center electrode side tip 31). That is, the ground electrode 27 is configured to largely project substantially from the front end of the metallic shell 3 toward the axis CL1 direction leading to the front end side. The spark discharge gap 33 is configured to be disposed at the center side of the combustion chamber.

Assuming that the length along the central axis CL2 of the ground electrode 27 is L (mm) and the projection length of the ground electrode 27 relative to the front end of the metallic shell 3 along the axis CL1 is X (mm), this embodiment is configured so as to satisfy $L/X \leq 1.28$. In this embodiment, the length L is set within a predetermined value range (for example, equal to or more than 6 mm and equal to or less than 10 mm), and a projection length X is set within a predetermined value range (for example, equal to or more than 5 mm and equal to or less than 8 mm). Additionally, satisfying L/X≤1.28 sets the length from the outermost circumference of the base end portion of the ground electrode 27 along the direction perpendicular to the axis CL1 to the front end of the ground electrode 27, namely, a projection amount Y, which is the projection amount of the ground electrode 27 from a position where the ground electrode 27 is secured to the metallic shell 3 to the axis CL1 side, is comparatively small (for example, equal to or more than 4 mm and equal to or less than 6 mm).

Furthermore, in this embodiment, the ground electrode 27 has a constant cross section area S1 ($mm^2$), which is a cross section perpendicular to the central axis CL2, at the base end side with respect to the ground electrode side tip 32 as shown in FIG. 4(*a*) and FIG. 4(*b*) (FIG. 4(*a*) is a sectional view taken along the line J-J of FIG. 2, and FIG. 4(*b*) is a sectional view taken along the line K-K of FIG. 2). Further, in this embodiment, the cross section area S1 ($mm^2$) is configured to satisfy 1.7≤S1≤3.0.

Additionally, as shown in FIG. 5 (FIG. 5 is a sectional view taken along the line P-P of FIG. 2), assume that the cross section area of the ground electrode side tip 32 at the cross section perpendicular to the projection direction of the ground electrode side tip 32 relative to the front end of the ground electrode 27 is S2 ($mm^2$). Also, as shown in FIG. 2, assume that the projection length of the ground electrode side tip 32 relative to the front end face 27F of the ground electrode 27 in the longitudinal direction of the ground electrode 27 as A (mm). The cross section areas S1 and S2 and a projection length A are configured to satisfy 8.4 ($mm^{-1}$)≤(S1/S2)/A.

The ground electrode side tip 32 has a projecting portion 32P projected from the front end face 27F of the ground electrode 27 (the portion illustrated by the dot pattern in FIG. 2). The projecting portion 32P has a volume (S2×A) equivalent to the heat receiving amount of the projecting portion 32P during operation of the internal combustion engine or the like. The cross section area S1 is equivalent to capacity (the heat conduction capacity of the ground electrode 27) that the ground electrode 27 conducts heat of the projecting portion 32P to the metallic shell 3 side. Then, satisfying 8.4≤(S1/S2)/A, namely, 8.4≤S1/(S2×A) sufficiently increases the heat conduction capacity of the ground electrode 27 relative to the heat receiving amount of the projecting portion 32P, resulting in prevention of overheating of the tip 32.

Note that (S1/S2)/A ($mm^{-1}$) is, so to speak, equivalent to the heat conduction capacity of the ground electrode 27 per unit length of the projecting portion 32P. The overheating of the tip 32 can be efficiently prevented as (S1/S2)/A increases. Accordingly, to work more efficiently and further effectively prevent overheating of the tip 32, satisfying 13.1 ($mm^{-1}$)≤(S1/S2)/A is preferable.

As described above, according to this embodiment, the flexed portion 27K is disposed at the ground electrode 27. This allows forming a comparatively large space between the ground electrode 27 and the center electrode 5 and further reliably preventing inhibition of growth of a spark by the ground electrode 27. Furthermore, since the center CE of the front end face 27F of the ground electrode 27 is located at the front end side in the axis CL1 direction with respect to the front end of the center electrode 5, allowing the spark discharge gap 33 to be formed at the center side of the combustion chamber. Consequently, good ignitability can be achieved.

Furthermore, this embodiment is configured to satisfy L/X≤1.28. A projection amount Y of the ground electrode 27 toward the axis CL1 side is formed comparatively small. Accordingly, stress applied to the flexed portion 27K by a vibration can be efficiently reduced. As a result, breakage of the flexed portion 27K of the ground electrode 27 can be further reliably prevented.

Additionally, the ground electrode side tip 32, which partially projects from the front end face 27F and the inner circumference-side side surface 27S of the ground electrode 27, is joined to the front end portion of the ground electrode 27. The spark discharge gap 33 is formed between the ground electrode side tip 32 and the front end portion of the center electrode 5. Therefore, even if the projection amount Y is comparatively small, the spark discharge gap 33 with the appropriate size can be formed. As a result, the above-described good ignitability can be stably produced.

Since the ground electrode side tip 32 partially projects from the front end face 27F and the inner circumference-side side surface 27S, the ground electrode 27 is further away from the spark discharge gap 33. This allows further reliably preventing inhibition of growth of a spark by the ground electrode 27 and achieving further superior ignitability.

Additionally, in this embodiment, 8.4 ($mm^{-1}$)≤(S1/S2)/A is satisfied, allowing efficient prevention of overheating the ground electrode side tip 32. This also allows sufficiently maintaining the strength of the ground electrode side tip 32 under high temperature and further reliably preventing the breakage of the ground electrode side tip 32.

In addition, the ground electrode 27 includes the inner layer 27B with higher thermal conductivity than that of the outer layer 27A. This allows the heat of the ground electrode side tip 32 to be smoothly conducted to the metallic shell 3 side via the inner layer 27B and further reliably preventing the overheating of the ground electrode side tip 32. As a result, the breakage resistance of the ground electrode side tip 32 can be further improved.

Additionally, in this embodiment, the cross section area S1 of the ground electrode 27 is equal to or less than 3.0 $mm^2$. This reduces the likelihood of inhibition of growth of a spark due to the existence of the ground electrode 27. Additionally, in the case where the ground electrode 27 is disposed between the spark discharge gap 33 and the fuel injection device, air-fuel mixture runs around the ground electrode 27 and easily gets through the spark discharge gap 33. This further improves ignitability.

Meanwhile, in the case where the cross section area S1 is equal to or less than 3.0 $mm^2$, the heat conduction capacity of the ground electrode 27 possibly degrades. However, disposing the inner layer 27B at the ground electrode 27 allows ensuring superior heat conduction capacity of the ground electrode 27. As a result, ignitability is further improved while maintaining superior breakage resistance at the ground electrode side tip 32.

Additionally, the cross section area S1 is equal to or more than 1.7 $mm^2$. This allows further reliably ensuring superior heat conduction capacity at the ground electrode 27 and further reliably improving the breakage resistance of the ground electrode side tip 32.

Next, to confirm actions and effects achieved by the above-described embodiment, spark plug samples where L/X was varied by changing the length L of the ground electrode and the projection length X of the ground electrode relative to the front end of the metallic shell were manufactured. The ground electrode was checked for breakage resistance by conducting a benchtop vibration resistance test and an actual engine vibration resistance test on each sample.

Note that the benchtop vibration resistance test was conducted as follows. A sample where a 3 g weight was mounted to the front end portion of the ground electrode was installed to the predetermined vibration tester. The ground electrode was heated to 900° C. by a burner. Then, a vibration was applied to the sample at a frequency of 200 Hz (that is, in proportion of 12000 times per minute) and acceleration of 60 G. The actual engine vibration resistance test was conducted as follows. A sample was mounted to a six-cylinder engine with displacement of 3.2 L. The engine revolution was set to 6900 rpm. Then, an engine was operated for 100 hours.

Additionally, the benchtop vibration resistance test was conducted as follows. After vibrating a sample $10^5$ times, the ground electrode was repeatedly checked for breakage until the sample was vibrated $10^6$ times in total. Then, after vibrating the sample $10^6$ times, the ground electrode was repeatedly checked for breakage until the sample was vibrated $10^7$ times in total. If breakage occurs in the ground electrode, the number of times the vibrations were applied until the breakage occurred (the number of times at breakage) was obtained. For example, if breakage did not occur in the ground electrode at the vibration of $5\times10^5$ times but breakage occurred in the ground electrode after the vibration of $6\times10^5$ times, the number of times at breakage of $6\times10^5$ times was obtained. Additionally, for example, if breakage did not occur in the ground electrode at the vibration of $3\times10^6$ times but breakage occurred in the ground electrode after the vibration of $4\times10^6$ times, the number of times at breakage of $4\times10^6$ times was obtained. Then, if breakage occurred in the ground electrode, the ground electrode was regarded to have poor breakage resistance and therefore evaluated as "poor". If breakage did not occur in the ground electrode even after the vibration of $10^7$ times, the ground electrode was regarded to have significantly superior breakage resistance and therefore evaluated as "excellent".

Furthermore, the actual engine vibration resistance test was conducted as follows. The ground electrode was checked after vibrating a sample for 100 hours. If breakage occurred in the ground electrode, the ground electrode was regarded to have poor breakage resistance and therefore evaluated as "poor". Although breakage did not occur in the ground electrode, if a crack was generated in the ground electrode, the ground electrode was regarded to have slightly inferior breakage resistance and therefore evaluated as "normal". Meanwhile, if neither breakage or a crack occurs in the ground electrode, the ground electrode was regarded to have superior breakage resistance and therefore evaluated as "good".

The results of both above-described tests are listed in Table 1, respectively. In Table 1, as a reference, the number of times at breakage in the sample where breakage occurred in the ground electrode in the benchtop vibration resistance test is also listed. The actual engine vibration resistance test was conducted on the samples 2, 3, and 5 to 7. "8.4≤(S1/S2)/A" was satisfied for each sample, and the cross section area S1 of the ground electrode was set to equal to or more than 1.7 $mm^2$. Additionally, the ground electrode was configured with a single metal (Ni alloy) without disposing an inner layer inside thereof.

TABLE 1

| | | | | BENCHTOP VIBRATION RESISTANCE TEST | | ACTUAL ENGINE VIBRATION RESISTANCE TEST |
|---|---|---|---|---|---|---|
| SAMPLE No. | PROJECTION LENGTH X (mm) | LENGTH L (mm) | L/X | EVALUATION OF BREAKAGE RESISTANCE OF GROUND ELECTRODE | NUMBER OF TIMES AT BREAKAGE | EVALUATION OF BREAKAGE RESISTANCE OF GROUND ELECTRODE |
| 1 | 7.6 | 11.10 | 1.46 | POOR | $3\times10^5$ | — |
| 2 | 6.4 | 9.40 | 1.47 | POOR | $7\times10^5$ | NORMAL |
| 3 | 7.7 | 10.70 | 1.39 | POOR | $1\times10^6$ | NORMAL |
| 4 | 6.2 | 8.90 | 1.44 | POOR | $3\times10^6$ | — |
| 5 | 6.7 | 9.20 | 1.37 | POOR | $4\times10^6$ | NORMAL |
| 6 | 8.0 | 10.50 | 1.31 | POOR | $8\times10^6$ | NORMAL |
| 7 | 6.6 | 8.47 | 1.28 | EXCELLENT | — | GOOD |
| 8 | 5.1 | 6.48 | 1.27 | EXCELLENT | — | — |
| 9 | 5.1 | 6.28 | 1.23 | EXCELLENT | — | — |

As illustrated in Table 1, it was found that the ground electrodes of the samples with L/X of equal to or less than 1.28 (samples 7 to 9) had superior breakage resistance. This probably occurred because of the following reasons. The projection length X with respect to the length L of the ground electrode was beyond a certain extent. Accordingly, the projection amount Y of the ground electrode from a position where the ground electrode was secured to the metallic shell to the axis side became comparatively small. Therefore, the stress applied to the flexed portion due to the vibration was sufficiently decreased corresponding to the projection amount Y.

Next, the projection length X was set to 6.6 mm, the length L was set to 8.47 mm, and L/X was set to 1.28. Spark plug samples where (S1/S2)/A was varied by changing the cross section area S1 of the ground electrode, the cross section area S2 of the ground electrode side tip, and the projection length A of the ground electrode side tip relative to the front end of the ground electrode were manufactured. The ground electrode side tip was checked for breakage resistance by conducting the above-described benchtop vibration resistance test and the above-described actual engine vibration resistance test on each sample.

In the benchtop vibration resistance test, if breakage occurred in the ground electrode side tip, the ground electrode side tip was regarded to have poor breakage resistance and therefore evaluated as "poor". Meanwhile, the sample where a crack was generated at the ground electrode side tip but breakage did not occur in the ground electrode side tip after the vibration of $10^7$ times, the ground electrode side tip was regarded to have superior breakage resistance and therefore evaluated as "good". If breakage and a crack did not occur in the ground electrode side tip even after the vibration of $10^7$ times, the ground electrode side tip was regarded to have significantly superior breakage resistance and therefore evaluated as "excellent".

Furthermore, in the actual engine vibration resistance test, if breakage occurred in the ground electrode side tip, the ground electrode side tip was regarded to have poor breakage resistance and therefore evaluated as "poor". Although breakage did not occur in the ground electrode side tip, if a crack was generated in the ground electrode side tip, the ground electrode side tip was regarded to have slightly inferior breakage resistance and therefore evaluated as "normal". Meanwhile, if neither breakage or a crack occurs in the ground electrode side tip, the ground electrode side tip was regarded to have superior breakage resistance and therefore evaluated as "good".

In the benchtop vibration resistance test, the case where a crack was generated at the ground electrode side tip was evaluated as "good" while in the actual engine vibration resistance test, the case where a crack was generated at the ground electrode side tip was evaluated as "normal". This is due to the following reason. In the benchtop vibration resistance test, thermal load and stress applied to the ground electrode side tip are large compared to those of the actual engine vibration resistance test. Accordingly, breakage and a crack of the ground electrode side tip are more likely to occur. Therefore, in the actual engine vibration resistance test, the samples evaluated as "good" have the ground electrode with superior breakage resistance. In the benchtop vibration resistance test, the samples evaluated as "excellent" have the ground electrode with significantly superior breakage resistance.

The results of both tests are listed in Table 2, respectively. The cross section area S1 of the ground electrode was set as equal to or more than 1.7 $mm^2$ and the ground electrode was configured with a single metal (Ni alloy) for each sample.

TABLE 2

| SAMPLE No. | CROSS SECTION AREA S1 ($mm^2$) | CROSS SECTION AREA S2 ($mm^2$) | A (mm) | (S1/S2)/A ($mm^{-1}$) | BENCHTOP VIBRATION RESISTANCE TEST EVALUATION OF BREAKAGE RESISTANCE OF TIP | ACTUAL ENGINE VIBRATION RESISTANCE TEST EVALUATION OF BREAKAGE RESISTANCE OF TIP |
|---|---|---|---|---|---|---|
| 11 | 2.94 | 0.49 | 0.90 | 6.7 | GOOD | NORMAL |
| 12 | 2.94 | 0.39 | 0.90 | 8.4 | GOOD | GOOD |
| 13 | 2.94 | 0.49 | 0.65 | 9.2 | GOOD | GOOD |
| 14 | 2.94 | 0.39 | 0.65 | 11.6 | GOOD | GOOD |
| 15 | 4.17 | 0.49 | 0.65 | 13.1 | EXCELLENT | GOOD |
| 16 | 4.17 | 0.39 | 0.65 | 16.4 | EXCELLENT | GOOD |

As illustrated in Table 2, it was found that the ground electrode side tips of the samples with (S1/S2)/A of equal to or more than 8.4 (samples 12 to 16) had superior breakage resistance, which is probably caused because of the following reason. The capacity of the ground electrode to conduct heat from the projecting portion of the ground electrode side tip sufficiently increased relative to the heat receiving amount of the projecting portion. Accordingly, the overheating of the ground electrode side tip and the reduction in strength was able to be suppressed.

Furthermore, it was confirmed that the samples satisfying 13.1≤(S1/S2)/A (the samples 15 and 16) featured significantly superior breakage resistance since the samples did not generate a crack and breakage at the ground electrode side tips even if an extremely stringent benchtop vibration resistance test was conducted.

From the above-described test results, to achieve superior breakage resistance both at the ground electrode and the ground electrode side tip, satisfying L/X≤1.28 and 8.4≤(S1/S2)/A is preferred.

Furthermore, to achieve further superior breakage resistance at the ground electrode side tip, satisfying 13.1≤(S1/S2)/A is further preferred.

Next, samples with an inner layer and samples without an inner layer were manufactured. The samples with an inner layer were spark plug samples where an inner layer made of copper was disposed inside of the ground electrode and (S1/S2)/A was variably changed. The samples without an inner layer were spark plug samples where an inner layer was not disposed, the ground electrode was configured with a single metal (Ni alloy), and (S1/S2)/A was variously changed. The above-described actual engine vibration resistance test was conducted on each sample by changing a period during which a vibration was applied from 100 hours to 200 hours (that is, a condition where breakage is more likely to occur in the ground electrode side tip). Then, the ground electrode side tip was checked for breakage resistance.

The results of the test are listed in Table 3. Note that the results were evaluated with the method similar to one described above. That is, if breakage occurred in the ground electrode side tip, the sample was evaluated as "poor". If breakage did not occur but a crack was generated at the ground electrode side tip, the sample was evaluated as "normal". If both a crack and the breakage did not occur in the ground electrode side tip, the sample was evaluated as "good".

TABLE 3

| CROSS SECTION AREA S1 ($mm^2$) | CROSS SECTION AREA S2 ($mm^2$) | A (mm) | (S1/S2)/A ($mm^{-1}$) | ACTUAL ENGINE VIBRATION RESISTANCE TEST WITHOUT INNER LAYER | ACTUAL ENGINE VIBRATION RESISTANCE TEST WITH INNER LAYER |
|---|---|---|---|---|---|
| 2.94 | 0.49 | 0.90 | 6.7 | NORMAL | GOOD |
| 2.94 | 0.39 | 0.90 | 8.4 | NORMAL | GOOD |
| 2.94 | 0.49 | 0.65 | 9.2 | NORMAL | GOOD |
| 2.94 | 0.39 | 0.65 | 11.6 | NORMAL | GOOD |
| 4.17 | 0.49 | 0.65 | 13.1 | NORMAL | GOOD |
| 4.17 | 0.39 | 0.65 | 16.4 | NORMAL | GOOD |

As illustrated in Table 3, it was found that breakage and even a crack did not occur in the ground electrode side tip of the samples with an inner layer even if the test was conducted under the condition where breakage was more likely to occur in the ground electrode side tip, and therefore the ground electrode side tip had extremely superior breakage resistance. This is possibly because of the following reason. By disposing an inner layer, heat of the ground electrode side tip is smoothly conducted to the metallic shell side via the inner layer, further efficiently restricting the overheating of the ground electrode side tip.

From the above-described test results, to further improve the breakage resistance of the ground electrode side tip, it is further preferred that the ground electrode be disposed with an inner layer made of a metal with higher thermal conductivity than that of the outer layer.

Next, spark plug samples where existence of an inner layer and the cross section area S1 of the ground electrode were varied were manufactured. The ground electrode side tip was checked for breakage resistance by conducting the above-described benchtop vibration resistance test on each sample. Note that in the test, the number of times vibrations were applied to the samples was maximum $10^{10}$ times, which is a condition where breakage is highly likely to occur in the ground electrode side tip. Then, after the vibration of $10^{10}$ times, in the case where breakage was not found at the ground electrode side tip, it was evaluated as "good" while in the case where breakage was generated at the ground electrode side tip, it was evaluated as "poor". The results of the test are listed in Table 4. In Table 4, as a reference, the number of times at breakage of the sample where breakage occurred in the ground electrode side tip is also listed. Additionally, in each sample, the ground electrode was configured such that the ground electrode had a constant cross section area S1 at the base end side with respect to the ground electrode side tip.

TABLE 4

| CROSS | BENCHTOP VIBRATION RESISTANCE TEST | | | |
|---|---|---|---|---|
| | WITHOUT INNER LAYER | | WITH INNER LAYER | |
| SECTION AREA S1 ($mm^2$) | EVAL-UATION | NUMBER OF TIMES AT BREAKAGE | EVAL-UATION | NUMBER OF TIMES AT BREAKAGE |
| 4.2 | GOOD | — | GOOD | — |
| 3.5 | GOOD | — | GOOD | — |
| 3.0 | POOR | $7 \times 10^9$ | GOOD | — |
| 2.4 | POOR | $2 \times 10^9$ | GOOD | — |
| 1.7 | POOR | $8 \times 10^9$ | GOOD | — |
| 1.2 | POOR | $2 \times 10^9$ | POOR | $6 \times 10^9$ |

As illustrated in Table 4, in the case where the cross section area S1 was configured to be equal to or more than 1.7 $mm^2$ and equal to or less than 3.0 $mm^2$, the samples without an inner layer caused breakage at the ground electrode side tip while the sample with an inner layer did not cause breakage at the ground electrode side tip and therefore had superior breakage resistance.

From the above-described test results, disposing an inner layer in the ground electrode is especially effective in the case where the cross section area S1 is equal to or more than 1.7 $mm^2$ and equal to or less than 3.0 $mm^2$ where ensuring breakage resistance is difficult for the ground electrode without an inner layer.

The present invention is not limited to the above-described embodiment, but may be embodied, for example, as follows. Of course, applications and modifications other than those exemplified below are also possible.

Figure 6:
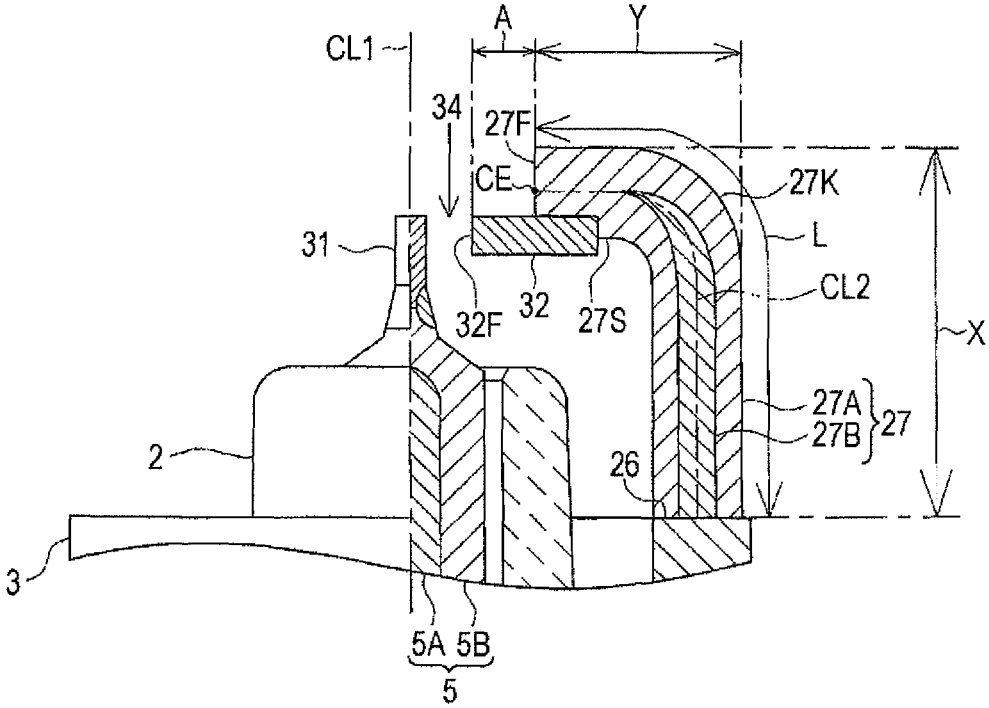
FIG. 6 is an enlarged, partially sectioned front view showing the configuration of the spark plug according to another embodiment.

(a) In the above-described embodiment, spark discharge is performed at the spark discharge gap 33 in the direction approximately along the axis CL1. In contrast to this, as shown in FIG. 6, a front end face 32F of the ground electrode side tip 32 may be configured so as to face the outer circumferential surface of the center electrode 5 (center electrode side tip 31). A spark discharge gap 34 may be formed between the front end face 32F of the ground electrode side tip 32 and the outer circumferential surface of the center electrode 5 (center electrode side tip 31). Spark discharge may occur at the spark discharge gap 34 along the direction approximately perpendicular to the axis CL1. In case of this, the length L of the ground electrode 27 can be further decreased. This allows reducing stress applied to the ground electrode 27 and the heat of the ground electrode side tip 32 to be further smoothly conducted to the metallic shell 3 side via the ground electrode 27. As a result, the breakage resistance of the ground electrode 27 and the ground electrode side tip 32 can be further improved.

Figure 7:
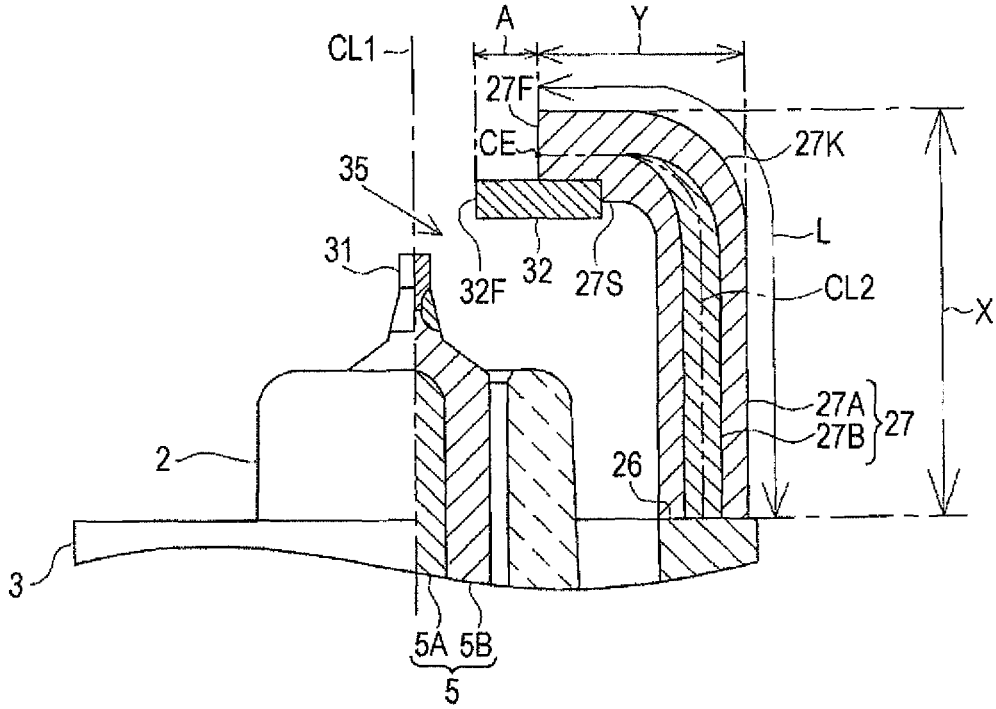
FIG. 7 is an enlarged, partially sectioned front view showing the configuration of the spark plug according to another embodiment.

Moreover, as shown in FIG. 7, the front end face 32F of the ground electrode side tip 32 may be disposed at the outer circumferential side with respect to the front end face of the center electrode 5 (center electrode side tip 31) and at the front end side in the axis CL1 direction with respect to the front end face of the center electrode 5. A spark discharge gap 35 may be formed between the ground electrode side tip 32 and the center electrode 5. Spark discharge may occur at the spark discharge gap 35 in the oblique direction intersecting with the axis CL1. In case of this, breakage resistance can further be improved at the ground electrode 27 and the ground electrode side tip 32 while maintaining superior ignitability.

(b) In the above-described embodiment, the ground electrode 27 has a two-layer construction including the outer layer 27A and the inner layer 27B. However, the ground electrode 27 may be a three-layer construction or multiple layer construction of equal to or more than four layers. Accordingly, for example, the inner layer 27B may include an innermost layer portion and an intermediate layer portion. The innermost layer portion is formed by a metal (e.g. pure Ni and pure Fe) with more superior thermal conductivity than a thermal conductivity of the outer layer 27A. The intermediate layer portion is made of a metal (e.g. copper and copper alloy) with higher thermal conductivity than a thermal conductivity of the outer layer 27A. The intermediate layer portion may be disposed between the outer layer 27A and the innermost layer portion.

(c) In the above-described embodiment, the center electrode side tip 31 is disposed at the center electrode 5. However, center electrode side tip 31 may not be disposed.

(d) In the above-described embodiment, the ground electrode 27 has a rectangular cross-sectional shape. However, the ground electrode 27 may have a circular cross-sectional shape or a polygonal cross-sectional shape.

(e) In the above-described embodiment, the present invention embodies a case in which the ground electrode 27 is joined to the front end portion 26 of the metallic shell 3. However, the present invention can also be applied to a case in which its ground electrode is formed, through cutting operation, from a portion (or a portion of a front end metal piece welded to the metallic shell in advance) of the metallic shell (see, for example, JP 2006-236906 A).

(f) In the above-described embodiment, the tool engagement portion 19 has a hexagonal cross-sectional shape. However, the shape of the tool engagement portion 19 is not limited thereto. For example, the tool engagement portion 19 may have a Bi-HEX (modified dodecagonal) shape [ISO22977:2005(E)] or the like.

REFERENCE NUMBER LIST

1: spark plug
2: insulator
3: metallic shell
4: axial hole
5: center electrode
27: ground electrode
27A: outer layer
27B: inner layer
27F: front end face (of ground electrode)
27K: flexed portion

27S: inner circumference-side side surface (of ground electrode)
32: ground electrode side tip (tip)
33: spark discharge gap (gap)
CE: center (of front end face of ground electrode)
CL1: axis
CL2: central axis (of ground electrode)

Having described the invention, the following is claimed:

1. A spark plug, comprising:

an insulator having an axial hole penetrating in a direction of an axis;

a center electrode inserted into the axial hole;

a tubular metallic shell disposed at an outer circumference of the insulator;

a ground electrode secured to a front end portion of the metallic shell, and bent to the axis side at a flexed portion; and a tip joined to a front end portion of the ground electrode to form a gap between the tip and a front end portion of the center electrode, wherein the tip is joined to the ground electrode with a part of the tip projecting from a front end face and an inner circumference-side side surface of the ground electrode, the ground electrode has a center of the front end face, the center being located at a front end side in the direction of the axis with respect to a front end of the center electrode;

$L/X \leq 1.28$ is satisfied, where L (mm) represents a length of the ground electrode along a central axis of the ground electrode and X (mm) represents a projection length of the ground electrode relative to a front end face of the metallic shell along the axis, and $8.4\text{-mm}^{-1} \leq (S1/S2)/A$ is satisfied, where S1 ($mm^2$) represents a cross section area of the ground electrode of a portion at a base end side of the ground electrode with respect to a portion where the tip is joined to the ground electrode in cross section perpendicular to the central axis of the ground electrode, S2 ($mm^2$) represents a cross section area of the tip in cross section perpendicular to a projection direction of the tip relative to the front end of the ground electrode, and A (mm) represents a projection length of the tip relative to the front end face of the ground electrode in a longitudinal direction of the ground electrode.

2. The spark plug according to claim 1, wherein $13.1\text{-mm}^{-1} \leq (S1/S2)/A$ is satisfied.

3. The spark plug according to claim 1 or 2, wherein the ground electrode includes an outer layer and an inner layer, the inner layer being disposed inside of the outer layer and being made of a metal with higher thermal conductivity than a thermal conductivity of the outer layer.

4. The spark plug according to claim 3, wherein $1.7\text{-mm}^2 \leq S1 \leq 3.0\text{-mm}^2$ is satisfied.

* * * * *